US007056269B2

(12) United States Patent
Cleveland et al.

(10) Patent No.: US 7,056,269 B2
(45) Date of Patent: Jun. 6, 2006

(54) PHYSICAL THERAPY TOOL

(76) Inventors: John J. Cleveland, 125 Kyle Rd., Oakland, TN (US) 38060; Christa O. Cleveland, 125 Kyle Rd., Oakland, TN (US) 38060

( * ) Notice: Subject to any disclaimer, the term of this patent is extended or adjusted under 35 U.S.C. 154(b) by 188 days.

(21) Appl. No.: 10/787,751

(22) Filed: Feb. 27, 2004

(65) Prior Publication Data

US 2005/0192170 A1 Sep. 1, 2005

(51) Int. Cl.
*A63B 71/00* (2006.01)

(52) U.S. Cl. ..... 482/148; 482/39; 482/44; 482/904

(58) Field of Classification Search ..... 482/44, 482/148, 39, 904; D21/460, 475–6, 308–9, D21/457; 434/188, 193, 200, 206, 211, 262, 434/247, 254, 258; 446/213, 489; 472/129, 472/128; 601/34
See application file for complete search history.

(56) References Cited

U.S. PATENT DOCUMENTS

| | | | | | |
|---|---|---|---|---|---|
| 169,625 | A | * | 11/1875 | Crandall | 482/81 |
| 1,007,526 | A | * | 10/1911 | Caro | 601/33 |
| D194,920 | S | * | 4/1963 | Darling | D21/811 |
| 3,184,884 | A | * | 5/1965 | Petrucelli | 446/27 |
| 3,419,272 | A | * | 12/1968 | Miller et al. | 473/439 |
| 3,532,340 | A | | 10/1970 | Nardiello | |
| 3,602,504 | A | * | 8/1971 | Chapman et al. | 473/416 |
| 3,690,655 | A | * | 9/1972 | Chapman | 482/109 |
| 3,901,503 | A | | 8/1975 | Klose | |
| 4,049,264 | A | * | 9/1977 | Holcombe, Jr. | 482/81 |
| 4,400,907 | A | * | 8/1983 | Alter et al. | 446/28 |
| 4,457,722 | A | * | 7/1984 | Housand | 434/260 |
| 4,471,957 | A | * | 9/1984 | Engalitcheff, Jr. | 482/5 |
| 4,480,831 | A | | 11/1984 | Muller-Deinhardt | |
| 4,607,625 | A | | 8/1986 | Schenck | |

(Continued)

FOREIGN PATENT DOCUMENTS

| | | |
|---|---|---|
| GB | 296056 | 8/1929 |

(Continued)

OTHER PUBLICATIONS

Flaghouse—Special Populations, Fall 1999 Catalog, p. 17—E8956, E6928; p. 5, E2423.*

(Continued)

*Primary Examiner*—Lori Amerson
(74) *Attorney, Agent, or Firm*—Richard C. Litman

(57) ABSTRACT

The physical therapy tool comprises a large hoop with several small rings that slide around the hoop for use as a physical therapy or exercise aid. Moving the small rings around the hoop provides a measured, repeatable, and variable circumduction exercise for the arms and shoulders. The hoop is positioned out from the wall, and a patient moves the roller rings around the hoop to exercise the patient's range of motion and flexibility of the arms. The hoop is adjustable in height and angle to accommodate various sitting or standing positions of a patient, and to vary the therapeutic effect and results. To complete an exercise, the patient must move all the rings counter-clockwise and return the rings to the starting point on the hoop. As a patient's range of motion and flexibility increases, a therapist may adjust the height of the hoop to maximize therapeutic results.

7 Claims, 6 Drawing Sheets

U.S. PATENT DOCUMENTS

| | | | | |
|---|---|---|---|---|
| 4,615,685 | A | 10/1986 | Nelissen | |
| 4,724,827 | A | 2/1988 | Schenck | |
| 4,772,015 | A * | 9/1988 | Carlson et al. | 482/92 |
| 4,836,818 | A * | 6/1989 | Piolata | 446/236 |
| 5,080,350 | A * | 1/1992 | Schofield et al. | 482/132 |
| 5,242,344 | A * | 9/1993 | Hundley | 482/93 |
| D344,765 | S * | 3/1994 | Miller, Jr. | D21/699 |
| 5,551,933 | A * | 9/1996 | Washburn | 482/44 |
| 5,674,162 | A | 10/1997 | Ellingson et al. | |
| 5,964,637 | A * | 10/1999 | Hardaway | 446/246 |
| 6,179,758 | B1 | 1/2001 | Domenge | |
| 2002/0155781 | A1 | 10/2002 | Lee | |
| 2005/0075216 | A1 * | 4/2005 | Chu | 482/44 |

FOREIGN PATENT DOCUMENTS

| | | |
|---|---|---|
| GB | 2 109 253 A | 6/1983 |

OTHER PUBLICATIONS

Abilitations, Spring 2001 Catalog, p. 149—426638394.*
Abilitations, Spring 1995 Catalog, p. 101.*

* cited by examiner

PHYSICAL THERAPY TOOL

BACKGROUND OF THE INVENTION

1. Field of the Invention

The present invention relates generally to an exercise apparatus. More specifically, the invention is a wall-attached, hinged plastic or nylon hoop with soft roller rings that can slide and be moved around the hoop by the user.

2. Description of the Related Art

The related art of interest describes the present state of the art, but does not disclose the present invention. There is a need for a simplified, economic and ergonomic wall-based exercising apparatus having a ring configuration. The related art of interest will be described in the order of perceived relevance to the present invention.

U.S. Pat. No. 3,901,503 issued on Aug. 26, 1975, to Odo Klose describes a weighted muscle exerciser apparatus comprising a disc-shaped hollow body having a central axis. A centrifugal weight moves around on a circular path around the central axis of the disc-shaped hollow body within an edge-grasp bead. The apparatus is distinguishable for requiring the weight to be rotated and confined inside the hollow ring body.

U.S. Pat. No. 5,674,162 issued on Oct. 7, 1997, to Richard L. Ellingson et al. describes a biochemical stabilizer apparatus for strengthening unstable joints and improving muscle coordination comprising a tubular ring that can be oval, ellipsoidal, toroidal, ring-shaped, semi-circular, etc. A programmable timer unit is disposed on the ring and crossbar. A second crossbar can be employed. The apparatus is distinguishable for requiring a programmable timer unit and one or two crossbars.

U.S. Pat. No. 4,480,831 issued on Nov. 6, 1984, to Friedhelm Muller-Deinhardt describes an exercise hoop having a counter comprising a hollow hoop having a weight enclosed. As the hoop is rotated, an enclosed counter counts and displays the weight's revolutions, and a sensor for determining and displaying the speed of the weight. The device is distinguishable for requiring a counter.

U.S. Patent Application Publication No. 2002/0155781 A1 published on Oct. 24, 2002, for Taek-Hyun Lee describes a multi-stage hula-hoop comprising a plurality of hollow hoops connected by five strings or including four magnets equally spaced in each hoop. The device is distinguishable for requiring attachment between hoops either by string or by magnets.

U.S. Pat. No. 3,532,340 issued on Oct. 6, 1970, to Vincent Nardiello describes a spring type abdominal exercising device comprising an inner circular body member attached by eight springs to an outer circular body member, wherein the inner member is attached to a user's waist by belt means. The apparatus is distinguishable for requiring two circular members connected by springs.

U.S. Pat. No. 4,607,625 issued on Aug. 26, 1986, and U.S. Pat. No. 4,724,827 issued on Feb. 16, 1988, as a continuation-in-part application to Robert R. Schenck describe a dynamic traction device for exercising a broken finger comprising a ring having a movable carriage traversing a track in the ring and elastically attached to the fractured finger in a splint or cast up to the forearm. By moving the injured finger the carriage can traverse the ring. The device is distinguishable for requiring a ring with an attachable carriage attached to the injured finger of the fist in a cast.

U.S. Pat. No. 4,615,685 issued on Oct. 7, 1986, to Pieter R. Koenraad Nelissen describes a twirling hoop game with an extensible tether comprising a hollow or solid ring made of wood, metal or plastic having an attached elastic band one-third the ring's diameter, and a handle rod attached to the band. The game involves grasping the rod and twirling the ring. The hoop is distinguishable for being freely swung and requiring an elastic band attached to it.

U.S. Pat. No. 6,179,758 B1 issued on Jan. 30, 2001, to Alberto G. Domenge describes an inertial exerciser device comprising an internal hollow casing containing at least one spherical shaped weight for moving within the casing to provide an inertial force. The device is distinguishable for requiring weights inside the hollow casing.

U.K. Patent Publication No. 296,056 published on Aug. 22, 1929, for Karel Lobosicky describes a device for exercising the wrist and fingers of musicians comprising four finger rings attached by elastic strings to a hooked standard held adjustably by a felt-lined bracket secured to the head of a violin so as to allow the fingers to be exercised in their natural positions over the finger board. The device is distinguishable for requiring a standard and four finger rings attached to it.

U.K. Patent Application Publication No. GB 2 109 253 A published on Jun. 2, 1983, for Lynda M. Clements describes a ring structure for massaging and exercising a human body by gyration. The device has a series of nodes extending around the inner circumference to project inward. The ring can have a plurality of releasably interlocking arcuate elements. The device is distinguishable for requiring a series of nodes and interlocking elements on the inside circumference of the ring device.

None of the above inventions and patents, taken either singly or in combination, is seen to describe the instant invention as claimed. Thus, a physical therapy tool solving the aforementioned problems is desired.

SUMMARY OF THE INVENTION

The physical therapy tool is a plastic or nylon hoop with soft roller rings that slide around the hoop that is hinged to a wall. Moving the rings around the hoop provides a measured, repeatable, and variable circumduction exercise for the arms and shoulders. The hoop is positioned out from the wall, and a patient moves the roller rings around the hoop to exercise the patient's range of motion and flexibility of the arms. The hoop is adjustable in height and angle to accommodate various sitting or standing positions of a patient, and to vary the therapeutic effect and results. To complete an exercise, the patient must move all the rings counter-clockwise and return the rings to the starting point on the hoop. As a patient's range of motion and flexibility increases, a therapist may adjust the height of the hoop to maximize therapeutic results.

Accordingly, it is a principal object of the invention to provide a physical therapy device containing a hoop hinged to a wall for storage and extended for exercise use.

It is another object of the invention to provide a physical therapy device containing a hoop having a plurality of rings on it.

It is a further object of the invention to provide a physical therapy device that will involve the movement of the rings around the ring by the user patient.

Still another object of the invention is to provide a physical therapy device that will involve exercising a user's arms to increase the mobility of either arm.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
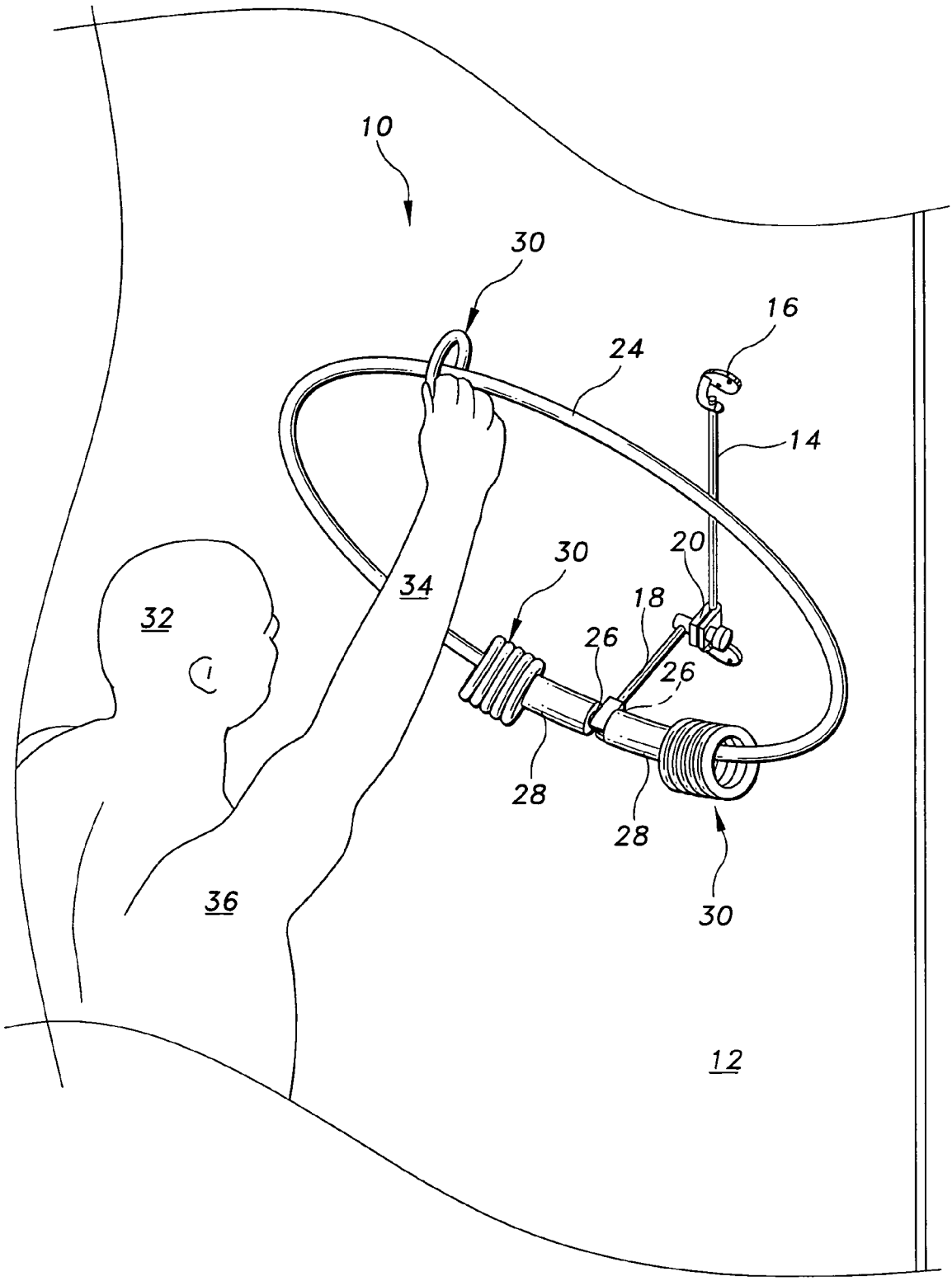
FIG. 1 is an environmental, perspective view of a physical therapy tool apparatus being used by a patient according to the present invention.
Figure 2:
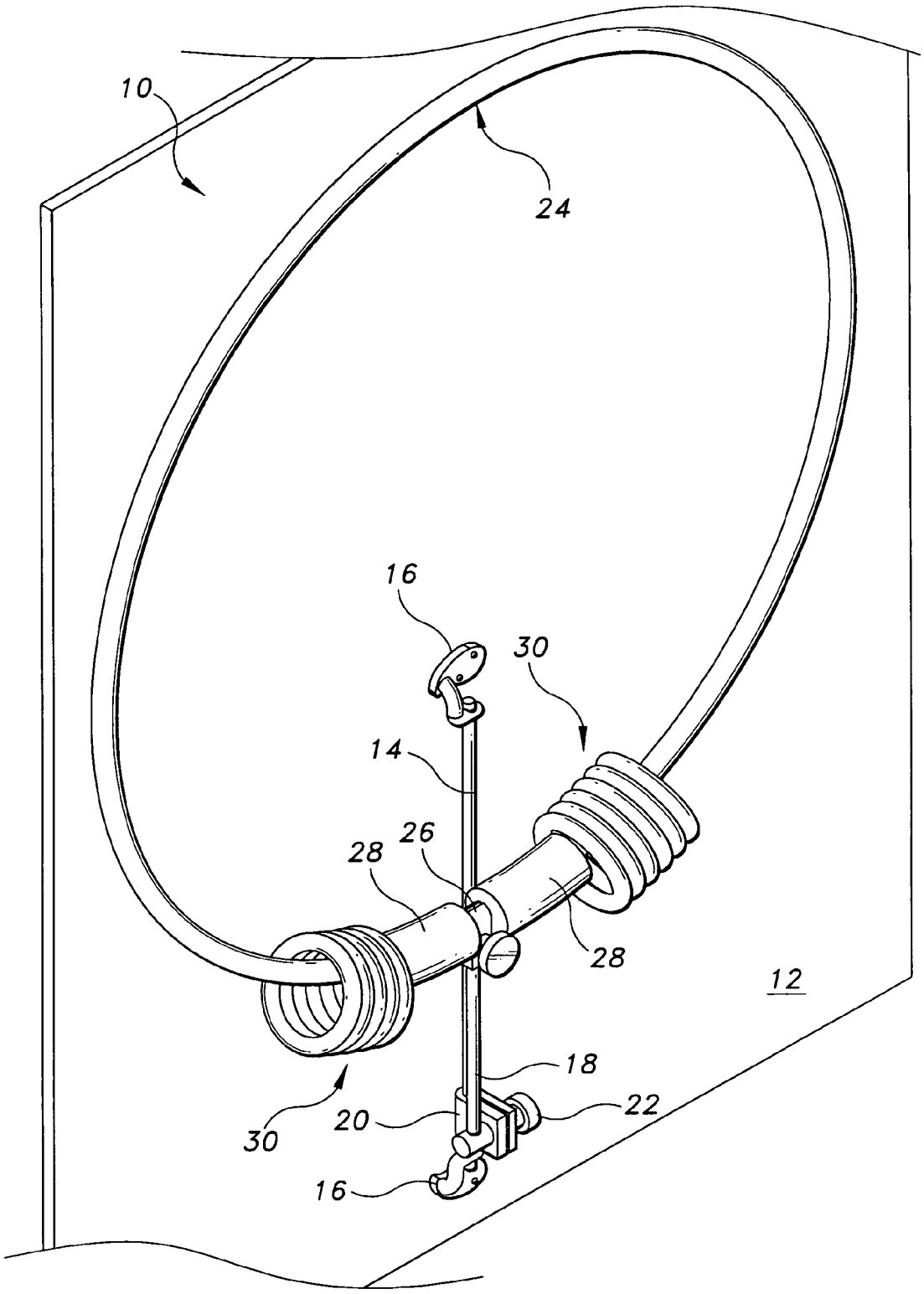
FIG. 2 is an elevational front view of the FIG. 1 therapy tool apparatus retracted and mounted on a wall.

The present invention is directed in FIGS. 1 and 2 to a physical therapy tool 10 that is hinged to a wall 12 by a height adjustable standard 14 and angular brackets 16. A swing arm 18 is slidably attached to the height adjustable standard 14 by sliding block 20 which is fixed in a place by tighting clamping knob 22. A circular hoop 24 is fastened to the swing arm by a hoop clamp 26. The circular hoop 24 is preferably a hoop of a plastic or similar material, having a diameter of approximately thirty two inches. The diameter may, of course, be varied to accommodate different patient sizes (such as adults vs. children), or to achieve different therapeutic toals and results. A plurality of small rings 30 are disposed about the circular hoop 24, and are free to slide along the circumference of the circular hoop 24. The small rings are made of plastic, rubber, or any suitable material. The hoop clamp 26 may be loosened to allow adjustment of the angle of the hoop 24, or tightened to secure the hoop in place. Foam rubber padding covers 28 are disposed on the hoop 24 adjacent to the hoop clamp 26, to aid in maintaining the plurality of small diameter rings 30 separated from the end lugs hoop clamp 26.

FIG. 1 illustrates the use of the physical therapy tool 10. A patient 32 moves the rings 30 completely around the hoop 24, from one side to the other, exercising his arm 34 and shoulder 36 in a circular manner or circumduction. The patient 32 will continue to move the available rings 30 from one side to the other and, once all the rings 30 are moved, begin moving the rings 30 back again to their original positions. This exercise can be repeated until the patient 32 becomes fatigued continuing the exercise becomes painful.

Figure 3A:
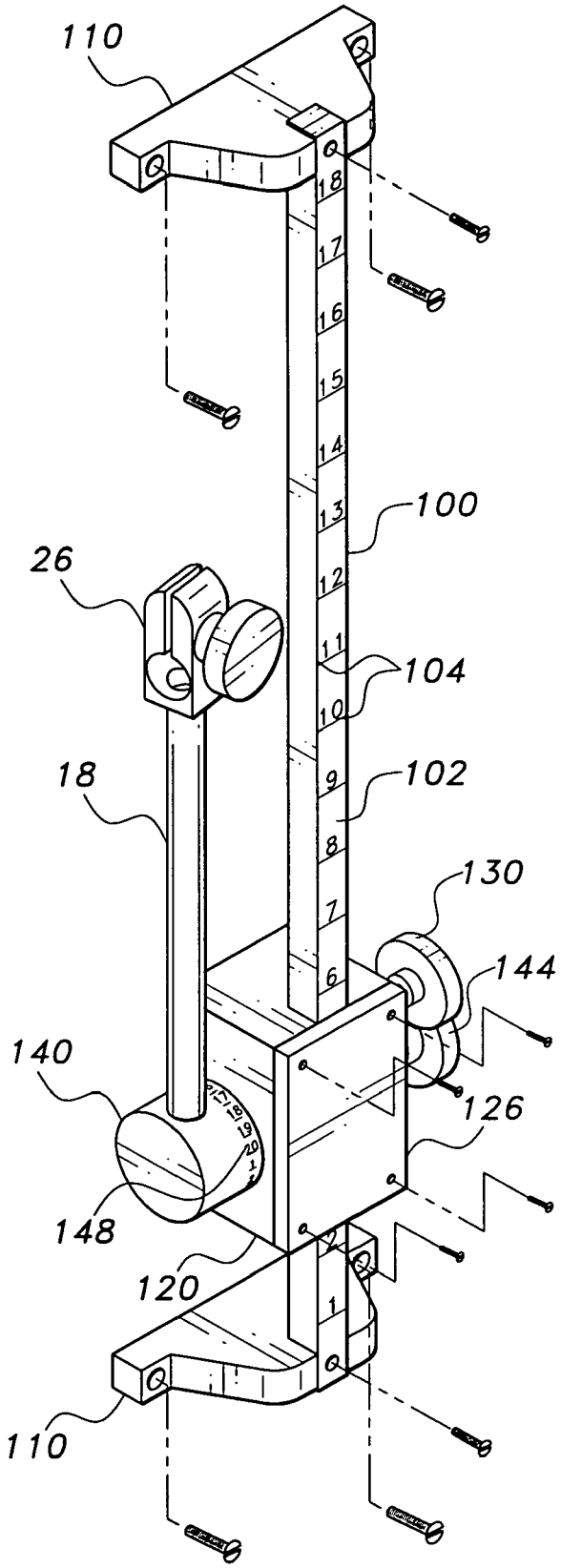
FIG. 3A is a perspective view of a mounting assembly for the physical therapy tool according to the present invention.
Figure 3B:
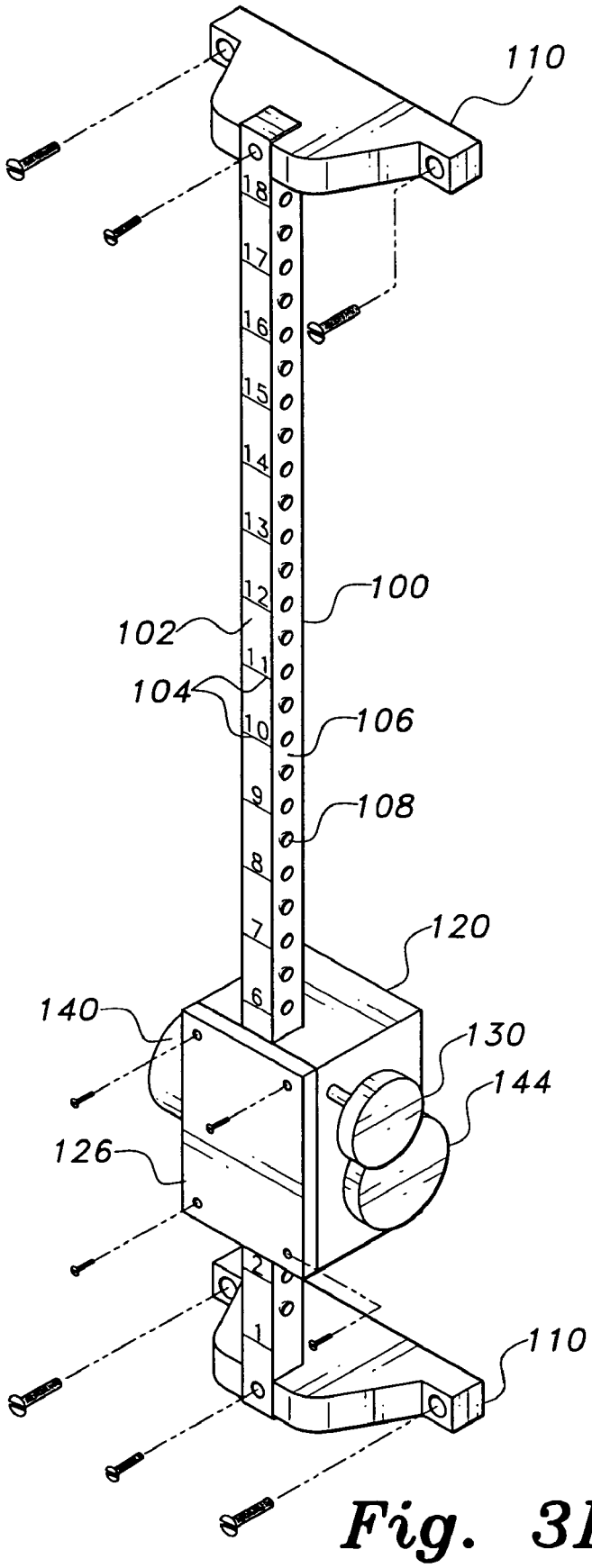
FIG. 3B is a perspective view of a mounting assembly for the physical therapy tool according to the present invention showing positioning detents defined along the upright standard.

Turning now to FIGS. 3A–3B, a preferred embodiment for the standard 100 and swing arm assembly is shown in greater detail. The standard 100 length of square stock, preferably stainless steel. A wall-mounting bracket 110 is disposed at each end of the standard 100. A front face 102 of the standard 100 is marked with visual indicia of a graduated height scale 104, the graduated height scale comprising a plurality of lengthwise unit measurements uniformly marked apart along the length of the upright standard. A plurality of detents 108 are defined in a side face 106 of the standard 100, the detents being spaced apart at even intervals along the length of the side face 106 and preferably corresponding to the graduated height scale 104. A sliding block 120 is disposed on the standard 100 and is slidable along the length of the standard 100. The sliding block 120 may be fixed in place by tightening a clamping knob 130 to prevent the sliding block 120 from sliding.

A swing arm mounting hub 140 is pivotally mounted to the sliding block 120. A cylindrical surface of the mounting hub 140 is marked with visual indicia of a graduated scale 148, the scale extending around the circumference of the mounting hub 140. The swing arm 18 extends radially from the mounting hub 140.

Figure 4:
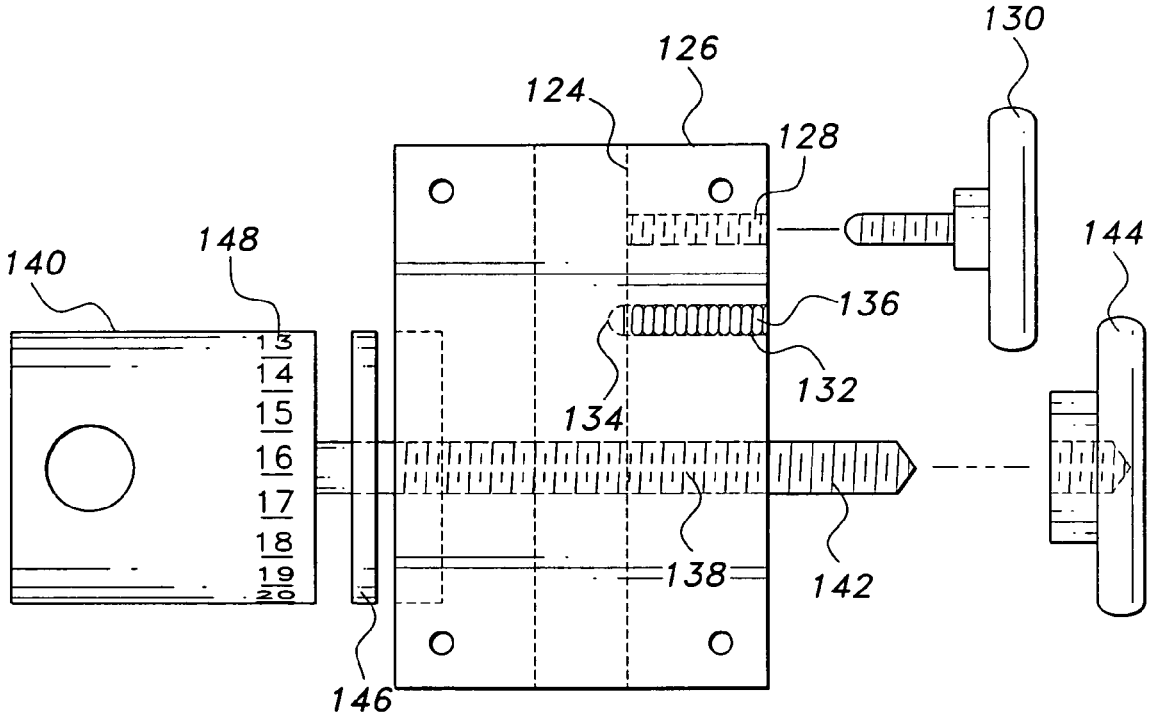
FIG. 4 is a front view of a sliding block member of the physical therapy tool according to the present invention.
Figure 5:
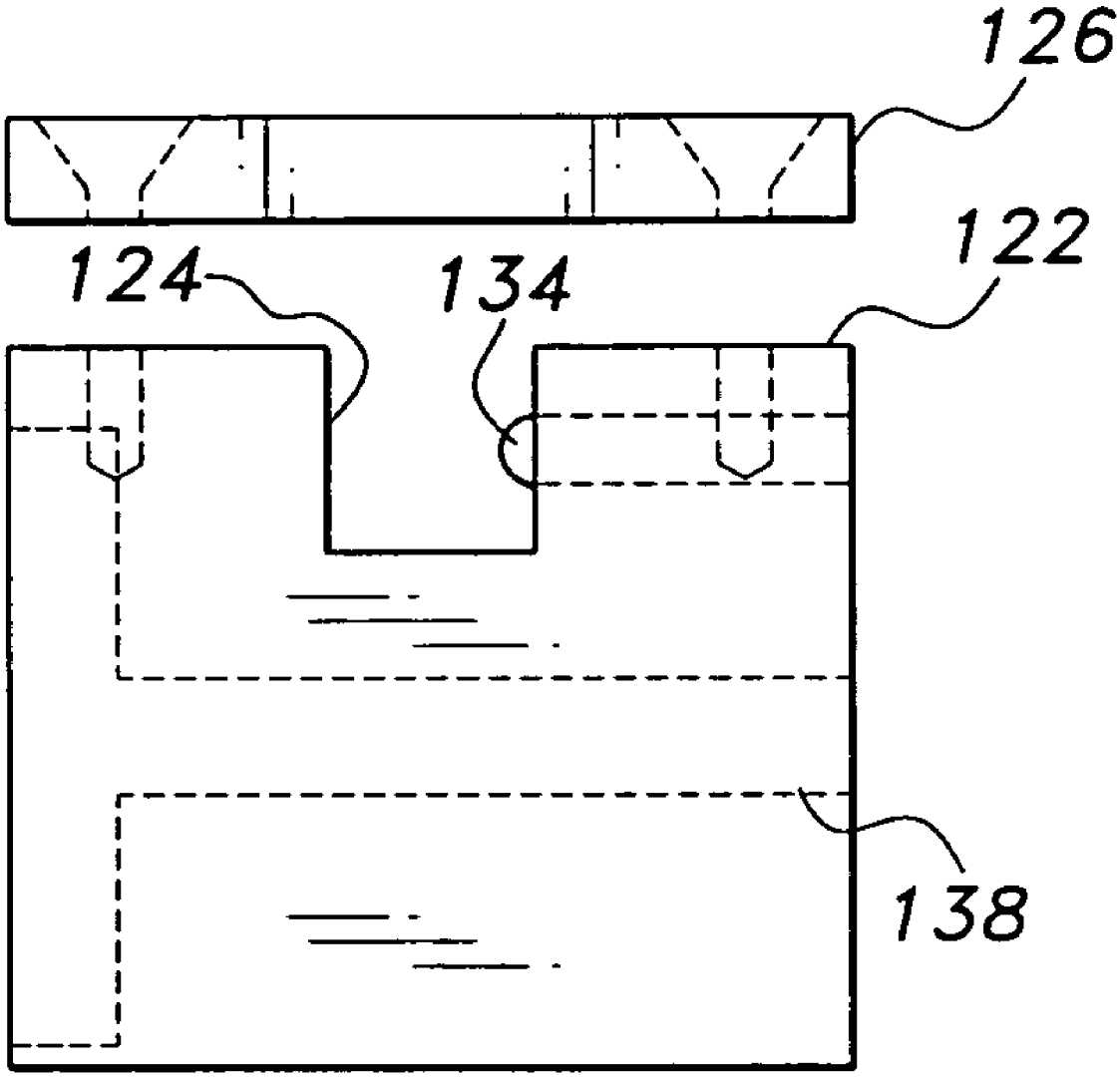
FIG. 5 is a top view of a sliding block member of the physical therapy tool according to the present invention.

Turning now to FIGS. 4 and 5, the sliding block 120 and mounting hub 140 are seen in greater detail. The sliding block 120 is a generally square or rectangular metal block having a front side 122, there being a longitudinal channel 124 defined in the front side. A cover plate 126 fits over the front side 122. It can be recognized that the channel 124 is dimensioned to receive the standard 100 such that the sliding block 120 is slidably retained on the standard 100. A threaded aperture 128 is defined in the sliding block 120 parallel to the front face 122 and in communication with the channel 124, whereby a threaded clamp knob 130 may be threadably engaged with the threaded aperture 128 and tightened against standard 100 disposed within the channel 124.

An aperture 132 is defined in the sliding block 120 parallel to the front face and in communication with the channel 124. A plunger 134, or ball bearing or the like, and a compression spring 136 are disposed within the aperture 132 whereby the compression spring 136 biases the plunger 134 toward engagement with the detents 108 defined in the standard 100 disposed within the channel 124.

A swing arm mounting aperture 138 is defined through the sliding block 120 and parallel to the front side 122. An axle 142 extends from the mounting hub 140, the axle being at least partially threaded. The mounting hub 140 is pivoltally mounted to the sliding block 120 with axle 142 extending through the swing arm mounting aperture 138. Swing arm tightening knob 144 threadably engages with the axle 142 to tighten the mounting hub 140 in position. A friction disk 146 may be disposed on the axle 142 between the mounting hub 140 and the sliding block 120 to provide a necessary amount of friction so that the mounting hub 140 may be securely fixed in position by tightening the swing arm tightening knob 144.

Thus, an individual desiring the exercise of the rotator cuff, arms and shoulders can even use this apparatus at home mounted on a wall. The apparatus can be folded up against the wall when not in use.

It is to be understood that the present invention is not limited to the embodiment described above, but encompasses any and all embodiments within the scope of the following claims.

We claim:

1. A physical therapy tool, comprising:

an upright standard having top and bottom ends;

a clamping block slidably disposed on said standard, wherein said clamping block comprises a generally rectangular block having a front face, there being a channel defined longitudinally within said front face, said upright standard being slidably disposed within said channel;

a first aperture defined in said clamping block, the first aperture being parallel to said front face and in communication with said channel;

a plunger disposed within said first aperture;

a compression spring disposed within said first aperture and biasing said plunger toward said channel;

a swing arm assembly rotatably attached to said clamping block;

a circular hoop cantilevered by said swing arm; and at least one small ring slidably disposed on said circular hoop.

2. The physical therapy tool according to claim 1, further comprising a plurality of detents defined on said upright standard, the detents being uniformly spaced apart along the length of said upright standard.

3. The physical therapy tool according to claim 1, further comprising a visual indicia of a graduated height scale marked on said upright standard.

4. The physical therapy tool according to claim 3, wherein said visual indicia of a graduated height scale comprises visual indicia of a plurality of lengthwise unit measurements uniformly spaced apart along the length of said upright standard.

5. The physical therapy tool according to claim 1, wherein said swing arm assembly comprises:

a hub having a cylindrical surface;

a swing arm extending radially from said hub; and an axle extending axially from aid hub, the axle being rotatably engaged with said clamping block.

6. The physical therapy tool according to claim 5, further comprising a visual indicia of a graduated scale marked around the cylindrical surface of said hub.

7. A physical therapy tool, comprising:

an upright standard having top and bottom ends;

a clamping block slidably disposed on said standard, wherein said clamping block comprises a generally rectangular block having a front face, there being a channel defined longitudinally within said front face, said upright standard being slidably disposed within said channel;

a visual indicia of a graduated height scale marked on said upright standard, wherein said visual indicia of a graduated height scale comprises visual indicia of a plurality of lengthwise unit measurements uniformly spaced apart along the length of said upright standard;

a plurality of detents defined on said upright standard, the detents being uniformly spaced apart along the length of said upright standard and corresponding with said lengthwise unit measurements;

a swing arm assembly rotatably attached to said clamping block;

a circular hoop cantilevered by said swing arm; and at least one small ring slidably disposed on said circular hoop.

* * * * *